US007186445B2

(12) United States Patent
Putkisto et al.

(10) Patent No.: US 7,186,445 B2
(45) Date of Patent: Mar. 6, 2007

(54) METHOD FOR ELECTROSTATIC COATING OF A PAPER WEB

(75) Inventors: Kaisa Putkisto, Tampere (FI); Juha Maijala, Järvenpää (FI); Veli Käsmä, Tampere (FI)

(73) Assignee: Metso Paper, Inc., Helsinki (FI)

( * ) Notice: Subject to any disclaimer, the term of this patent is extended or adjusted under 35 U.S.C. 154(b) by 16 days.

(21) Appl. No.: 10/507,417

(22) PCT Filed: Mar. 11, 2003

(86) PCT No.: PCT/FI03/00180

§ 371 (c)(1),
(2), (4) Date: Feb. 3, 2005

(87) PCT Pub. No.: WO03/076715

PCT Pub. Date: Sep. 18, 2003

(65) Prior Publication Data

US 2005/0118347 A1 Jun. 2, 2005

(30) Foreign Application Priority Data

Mar. 14, 2002 (FI) ..... 20020479
Jun. 26, 2002 (FI) ..... 20021253

(51) Int. Cl.
*B05D 1/06* (2006.01)

(52) U.S. Cl. ..... 427/482; 427/475; 427/477

(58) Field of Classification Search ..... 427/475, 427/477, 482

See application file for complete search history.

(56) References Cited

U.S. PATENT DOCUMENTS 3,521,558 A * 7/1970 Patterson et al. ..... 101/114
3,930,614 A 1/1976 Krenkel
5,344,082 A * 9/1994 Haller et al. ..... 239/697

FOREIGN PATENT DOCUMENTS

DE 26 46 798 A1 4/1978
EP 0 782 934 A1 7/1997
WO WO 97/36049 A1 10/1997
WO WO 03/076715 A2 9/2003

OTHER PUBLICATIONS

International Search Report issued in PCT/FI03/00180 as Pub. No. WO 03/076715 A3.
International Preliminary Examination Report issued in PCT/FI03/00180.

* cited by examiner

*Primary Examiner*—Fred J. Parker
(74) *Attorney, Agent, or Firm*—Stiennon & Stiennon

(57) ABSTRACT

A method for preliminary treatment of particles of a powder in a dry surface treatment process before applying the powder particles on a surface of a substrate by utilizing an electric field created by electrodes. The Electrodes are located at opposite sides of the substrate in such a way that at least one first electrode is located at the side of the substrate to be coated, and at least one second electrode is located at the opposites side of the substrate. The particles of the powder are pre-charged before bringing them into the electric field.

12 Claims, 2 Drawing Sheets

METHOD FOR ELECTROSTATIC COATING OF A PAPER WEB

CROSS REFERENCES TO RELATED APPLICATIONS

This application is a U.S. national stage application of International application No. PCT/FI03/00180, filed Mar. 11, 2003 and claims priority on Finnish Application No. 20020479, Filed Mar. 14, 2002, and Finnish Application No. 20021253, Filed Jun. 26, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for a preliminary treatment of particles of a powder in a dry surface treatment process before applying the powder particles on a surface of a substrate by utilizing an electric field created by electrodes, which are located at opposite sides of the substrate in such a way that at least one first electrode is located at the side of the substrate to be coated, and at least one second electrode is located at the opposite side of the substrate.

The dry surface treatment process of different substrates, such as paper, board, plastic, or metallic substrates, comprises dry powder application followed by a finishing step, for example thermomechanical fixing. The application of the powder utilizes an electric field to transfer the powder particles to the surface of the substrate and to enable an electrostatic adhesion prior to the finishing. Both the final adhesion and the surface smoothening of the dry powder are executed simultaneously through thermomechanical treatment or another suitable treatment. The powder, which is used, may be a coating composition comprising inorganic particles and binder particles, or a film forming material, which can be finished so that a pinhole-free film layer is formed.

In a dry surface treatment process, the charging of the powder has an essential role. If some inadequacies relating an amount of the charged particles, or a level of charging of a particle occur, it has an effect on efficiency and a cleanliness of the process. If the particles of the dry powder do not adhere properly to a substrate it causes an uneven powder layer on the substrate, dusting, material losses, and possibly harmful deposits.

SUMMARY OF THE INVENTION

The method of the invention is an enhancement to the dry surface treatment process, and it diminishes the above-mentioned problems of the dry surface treatment process. The method is characterized in that the particles of the powder are pre-charged before bringing them into the electric field.

The method of the invention makes the efficiency of the dry surface treatment process better because the dry powder places itself on the substrate properly, and no material losses occur. As a consequence, also a coating layer of a higher quality is achieved. A clean process without dusting is also attained.

In a dry surface treatment process, an electric field is created between electrodes, which are in different potentials. A substrate to be coated is between the electrodes. At least one of the electrodes may be a corona charging electrode which charges surrounding gas. The charged gas atoms, molecules or molecule groups attach to particles of the coating powder, thus giving a charge to the particle.

A force according to the equation $\overline{F}=q\overline{E}$, where $\overline{E}$ is an electric field, F is the force, and q is a charge, has an influence on a charge q in an electric field E. The force tends to convey the charge in the electric field, and in a stationary electric field only a position of the charge is meaningful. When a potential of the electric field is known, the strength of the electric field in a certain position is derived from the following equation:

$$\overline{E} = -\frac{\partial V}{\partial n}\overline{u}_n, \text{ where}$$

$\overline{E}$ is the strength of the electric field, $V$ is the potential of the electric field, and $\overline{u}_n$ is the unit vector of the perpendicular of the plane.

The strength of the electric field can also be evaluated by the electric charge density when the relation between the electric flux density and the strength of the electric field is taken into consideration. The equation below is Gauss's law.

$$\frac{\partial E_x}{\partial x} + \frac{\partial E_y}{\partial y} + \frac{\partial E_z}{\partial z} = \frac{\rho}{\varepsilon}, \text{ where}$$

$E_{x,y,z}$ are the dimensional strengths of the electric field, $\rho$ is a local electric charge density, and $\varepsilon$ is the dielectric constant of the examined space.

As seen from the equation above, in a stationary electric field the charges create the field, and the distribution and the magnitude of the charges determine the strength of the field in different positions.

If a conductive particle (radius a, charge q) is exposed to a uniform electric field $E_0$ in a unipolaric ion concentration $N_0$, the electric field at the particle is formed from two components, namely an electric field created by the particle itself due to its own charge, and an outer electric field which is changed by the charge of the particle. This field is described by an equation $$E = 3E_0\cos\theta - \frac{q}{4\pi\varepsilon_0 a^2} \text{ where}$$

$E$ is the resultant electric field, $\theta$ Is the incidence angle of the electric field focused to a particle, $\varepsilon_0$ is the dielectric constant of the free space, $a$ is the diameter of the particle, and $q$ is the charge of the particle.

The term $3E_0\cos\theta$ describes the change of the electric field as a consequence of the presence of the conductive particle. $E_0$ is the undisturbed field. The charging of the particles is great, and it is restricted only by the ions conveyed onto the particle by the electric field. The change of the charge is defined as a stream, and it can be described by the equation $$\frac{dq}{dt} = N_0 eb \int_{\theta}^{\theta_0} \left(3E_0 \cos\theta - \frac{q}{4\pi\varepsilon_0 a^2}\right) dA \text{ where}$$

$q$ is the charge of the particle, $b$ is the mobility of ion, $e$ is the charge of the electron, $\theta_0$ is the critical angle of to the particle streaming charge, $dA$ is the area of the component $= 2\pi a^2 \sin\theta d\theta$, and $t$ is time The above mentioned equation shows that the charge continues to stream to the particle until the field created by the particle and the outer field are balanced out. When a saturation charge is known, the level of charging can be derived from the equation $$q(t) = q_s \frac{1}{1 + \tau/t}$$

where $\tau = 4\epsilon_0/N_0 eb$

For conductive materials, the saturation charge is $q_s = 12\pi a^2 \epsilon_0 E_0$. For non-conductive materials, to the equation shall be added $3\kappa/(\kappa+2)$.

The diffusion charge has also an effect on the particle. As a function of time, the diffusion charge can be expressed by the equation $$q(t) = \frac{akT}{e} \ln\left(1 + \frac{\pi a v N_0 e^2 t}{kT}\right) \text{ where}$$

$k$ is Bolzman's constant, $T$ is the temperature (K.), $e$ is the charge of the electron, $v$ is the thermal velocity of ions (rms), $N_0$ is the average amount of molecules in a certain volume, and $t$ is time.

As can be concluded from the above mentioned equations, time is an important factor in charging of particles.

The pre-charging of the particles of the coating powder can be made either when the particles are brought at the final electric field or before bringing them into the final electric field. The aim of the pre-charging is to obtain a longer charging period compared to the process having only one charging step. The benefits of the longer charging period are a more homogenous charging level and a greater force of the electric field having influence on the particle.

The first embodiment of the invention is to pre-charge the particles of the coating powder when they are about to arrive into the final electric field. The pre-charging process is conducted in such a way that at least one charging electrode comprising a feeding nozzle is located farther away from the substrate to be coated than other charging electrodes. The dry powder is led to the charging electrode, and particles of the dry powder are charged by the charging electrode. After that the pre-charged particles enter to the final electric field formed by the other charging electrodes, for example corona charging electrodes, on the same side of the substrate and a grounding electrode, or an electrode having an opposite sign on the opposite side of the substrate. The pre-charged particles are blown towards a substrate to be coated. The substrate is preferably in a web form. The grounding electrode can be a stationary platy electrode, or it can be a roll rotating about its axis. The rotating roll is a preferred choice.

The second embodiment of the invention is to pre-charge the particles of the coating powder in another electric field(s) before the final electric field. In this embodiment, a dry powder is led first to a separate electric field and after that to the final electric field. Particles of the dry powder are pre-charged in a charging unit comprising a corona charging electrode, an electrode having a different potential compared to the corona charging electrode (e.g. a grounding electrode, an electrode in a lower or opposite potential), and a feeding nozzle.

Particles may also be charged by triboelectric charging, for example charging the particles by a friction between the particles, and walls of a transfer pipe, or a storage bin. After that the particles enter to another charging unit, which conducts the final charging of the particles. The final electric field is formed by electrodes at apposite sides of the substrate. The electrodes can be corona charging electrodes and a grounding electrode; other suitable electrodes and a grounding electrode; or electrodes being of different potentials at opposite sides of the substrate. The pre-charged particles are blown towards a substrate to be coated through a nozzle.

BRIEF DESCRIPTION OF THE DRAWINGS

In the following, the invention will be described by means of figures.

DESCRIPTION OF THE PREFERRED EMBODIMENTS

Figure 1:
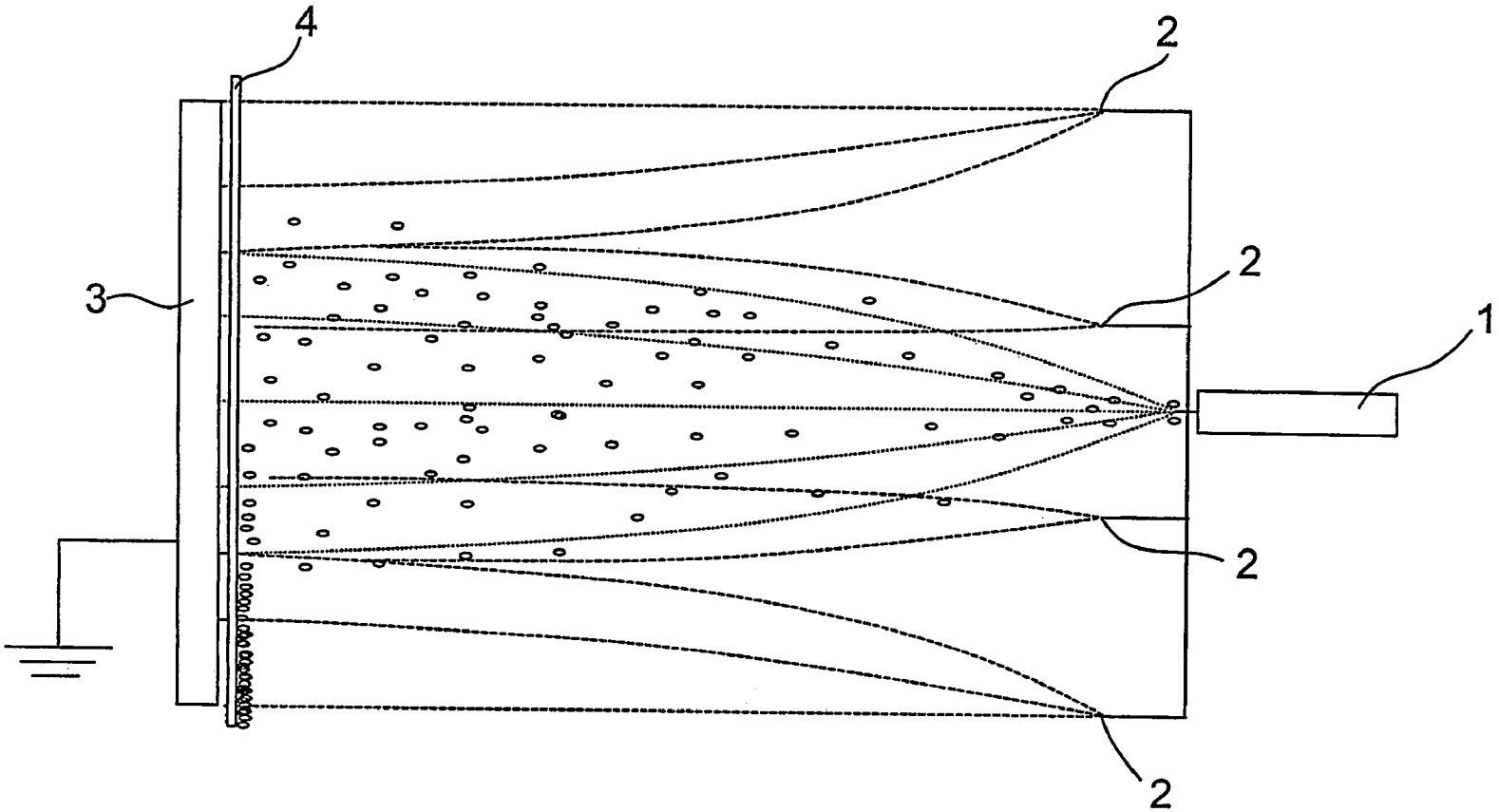
FIG. 1 shows the first embodiment of the invention.

According to FIG. 1, a dry powder is led to a charging electrode 1 comprising a feeding nozzle. Particles of the dry powder are charged by the charging electrode 1. The charging electrode is located farther from the substrate 4 than other electrodes 2 so that the particles are pre-charged when they enter to the final electric field formed by the corona charging electrodes 1,2 and a grounding electrode 3. The pre-charged particles are blown towards a substrate 4 to be coated. The substrate 4 is preferably in a web form. The grounding electrode 3 can be a stationary platy electrode, or it can be a roll rotating about its axis. The rotating roll is a preferred choice.

Figure 2:
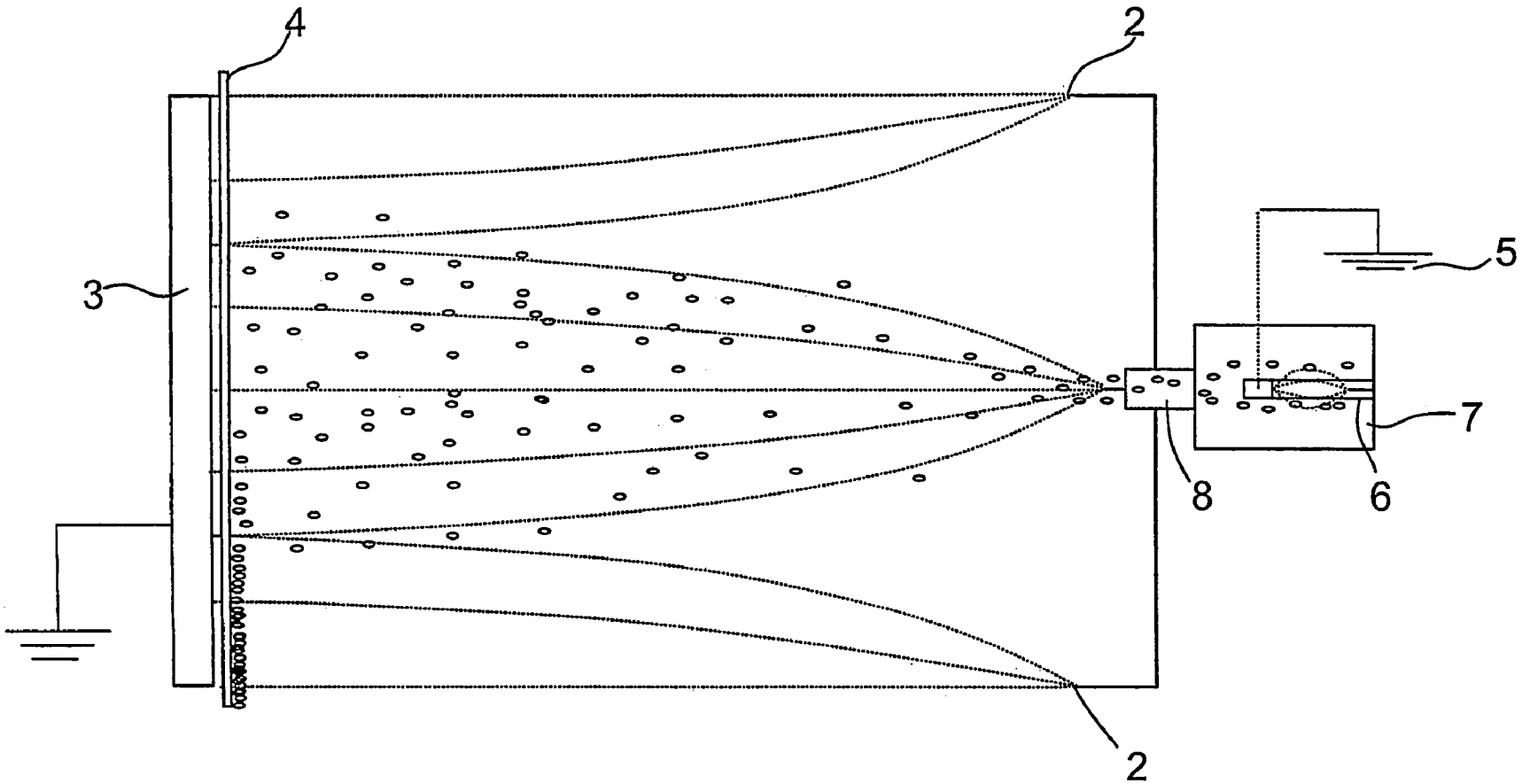
FIG. 2 shows the second embodiment of the invention.

According to FIG. 2, a dry powder is led to a first electric field and after that to a second electric field. Particles of the dry powder are charged in a charging unit 7 comprising a corona charging electrode 6, a grounding electrode 5, and a feeding nozzle 8. The particles are pre-charged in the first electric field created in the charging unit 7 before entering to the second electric field formed by the corona charging electrodes 2 and a grounding electrode 3. The pre-charged particles are blown towards a substrate 4 to be coated. As in the embodiment shown in FIG. 1, the remarks concerning the form of the substrate 4 and the preferred grounding electrode 3 are also valid in this embodiment.

The invention is not restricted to the description above, but the invention may vary within the scope of the claims.

The invention claimed is:

1. A method for coating a paper or board web in a dry surface treatment process, wherein motion of the paper or board web defines an upstream and a downstream direction, comprising the steps of:

pre-charging particles of a dry powder within a charging unit by causing the dry powder to move between an electrode producing corona charging within the unit and an electrode at a lower or opposite potential within the charging unit to form pre-charged particles;

supplying the pre-charged particles from the charging unit to a feeding nozzle which forms an electrode and blowing the pre-charged particles from the feeding nozzle toward the paper or board web, the feeding nozzle being positioned between an upstream electrode producing a corona discharge, the upstream electrode positioned outside of the charging unit and laterally spaced in the upstream direction from the feeding nozzle, and a downstream electrode producing a corona discharge, the downstream electrode positioned outside of the charging unit and laterally spaced in the downstream direction from the feeding nozzle, wherein the feeding nozzle is spaced further from the paper or board web than the upstream electrode and the downstream electrode;

wherein the paper or board web is backed by a grounding electrode at a potential which is lower than or opposite to the potentials of the feeding nozzle, the upstream electrode and the downstream electrode.

2. The method of claim 1 wherein the grounding electrode is a rotatable roll.

3. The method of claim 1 wherein the grounding electrode is a stationary platy electrode.

4. A method for coating a paper or board web in a dry surface treatment process, wherein motion of the paper or board web defines an upstream and a downstream direction, comprising the steps of:

pre-charging particles of a dry powder by causing the dry powder to move along the walls of a transfer pipe to charge the particles by triboelectric charging;

supplying the pre-charged particles to a feeding nozzle forming an electrode and blowing the pre-charged particles from the feeding nozzle toward the paper or board web, the feeding nozzle being positioned between an upstream electrode producing a corona discharge, the upstream electrode positioned laterally spaced in the upstream direction from the feeding nozzle, and a downstream electrode producing a corona discharge, the downstream electrode positioned laterally spaced in the downstream direction from the feeding nozzle, wherein the feeding nozzle is spaced further from the paper or board web than the upstream electrode and the downstream electrode;

wherein the paper or board web is backed by a grounding electrode at a potential which is lower than or opposite to the potentials of the feeding nozzle, the upstream electrode, and the downstream electrode.

5. The method of claim 4 wherein the grounding electrode is a rotatable roll.

6. The method of claim 4 wherein the grounding electrode is a stationary platy electrode.

7. A method for coating a moving web using a dry surface treatment process wherein the movement of the web defines an upstream direction and a downstream direction, comprising the steps of:

pre-charging particles of a dry powder within a charging unit by causing the dry powder to move between an electrode producing corona charging within the unit and an electrode at a lower or opposite potential within the charging unit to form pre-charged particles;

coating the web with a coating layer by supplying the pre-charged particles from the charging unit to a feeding nozzle which forms an electrode and blowing the pre-charged particles from the feeding nozzle toward the web, the feeding nozzle being positioned between an upstream electrode producing a corona discharge, the upstream electrode positioned outside of the charging unit and laterally spaced in the upstream direction from the feeding nozzle and a downstream electrode producing a corona discharge, the downstream electrode positioned outside of the charging unit and laterally spaced in the downstream direction from the feeding nozzle, wherein the feeding nozzle is spaced further from the web than the upstream electrode and the downstream electrode; and wherein the web is backed by a grounding electrode at a potential which is lower than or opposite to the potentials of the feeding nozzle, the upstream and the downstream electrodes.

8. The method of claim 7 wherein the grounding electrode is a rotatable roll.

9. The method of claim 7 wherein the grounding electrode is a stationary platy electrode.

10. A method for coating a moving web using a dry surface treatment process wherein the movement of the paper or board web defines an upstream direction and a downstream direction, comprising the steps of:

pre-charging particles of a dry powder by causing the dry powder to move along the walls of a transfer pipe to charge the particles by triboelectric charging;

supplying the pre-charged particles to a feeding nozzle forming an electrode and blowing the pre-charged particles from the feeding nozzle toward the web, the feeding nozzle being positioned between an upstream electrode producing a corona discharge, the upstream electrode positioned laterally spaced in the upstream direction from the feeding nozzle, and a downstream electrode producing a corona discharge, the downstream electrode positioned laterally spaced in the downstream direction from the feeding nozzle, wherein the feeding nozzle is spaced further from the paper or board web than the upstream electrode and the downstream electrode;

wherein the paper or board web is backed by a grounding electrode at a potential which is lower than or opposite to the potentials of the feeding nozzle, the upstream electrode, and the downstream electrode.

11. The method of claim 10 wherein the grounding electrode is a rotatable roll.

12. The method of claim 10 wherein the grounding electrode is a stationary platy electrode.

* * * * *